United States Patent [19]

Katoh

[11] Patent Number: 4,624,549

[45] Date of Patent: Nov. 25, 1986

[54] COPYING MACHINE WITH EASY REMOVAL OF IMAGE TRANSFER MEMBER

[75] Inventor: Itsurou Katoh, Nara, Japan

[73] Assignee: Sharp Kabushiki Kaisha, Osaka, Japan

[21] Appl. No.: 551,727

[22] Filed: Nov. 15, 1983

[30] Foreign Application Priority Data

Nov. 18, 1982 [JP] Japan ..... 57-203132

[51] Int. Cl.[4] ..... G03G 15/02; G03G 15/14; G03G 21/00

[52] U.S. Cl. ..... 355/3 BE; 355/3 TR; 355/3 CH; 355/16

[58] Field of Search ..... 355/3 R, 3 BE, 3 TR, 355/3 CH, 14 CH, 16

[56] References Cited

U.S. PATENT DOCUMENTS 4,141,648 2/1979 Gaitten et al. ..... 355/14 CH
4,372,669 2/1983 Fantuzzo et al. ..... 355/14 CH X
4,378,154 3/1983 Hoffman ..... 355/3 BE X
4,396,275 8/1983 Oka et al. ..... 355/3 BE X

*Primary Examiner*—Fred L. Braun
*Attorney, Agent, or Firm*—Birch, Stewart, Kolasch & Birch

[57] ABSTRACT

A photoelectric copying machine allows the sensitizer to form toner images that are transferred by being placed on a bell. The toner images formed by the sensitizer will be transferred onto the image transfer members with the image transfer members subsequently removed from contact with the sensitizer. The belt is supported by two drums having different diameters. A pair of drums each having a small diameter are available for moving the sensitizer. The drums set in positions from which the toner image on the sensitizer is transferred to the image transfer members, while the drums are arranged to come into contact with the sensitizer at an angle greater than 90° to enable removal of the image transfer members while the sensitizer is stably held by the drums and moved smoothly during the copying service.

9 Claims, 2 Drawing Figures

COPYING MACHINE WITH EASY REMOVAL OF IMAGE TRANSFER MEMBER

BACKGROUND OF THE INVENTION

The present invention relates to a photoelectric copying machine that removes image transfer members or sheets from a sensitizer after transferring a toner image from the sensitizer onto the image transfer members.

Conventionally, any existing photoelectric copying machine forms a toner image on a sensitizer on receipt of the draft picture by applying charge, exposure, and development onto the sensitizer before the toner image is transferred to an image transfer member being fed. After the transfer is completed, said image transfer member is removed from the sensitizer, eventually stabilizing the tone image after said image transfer member is sent to the stationary part.

As mentioned above, the conventional devices provide a variety of means for forcibly removing the image transfer members from the sensitizer after the sensitizer completes image transfer. Due to a structural need of conventional means for forcibly removing the tightly fixed image transfer member, said means necessarily incorporates relatively complex structures, thus unavoidably resulting in high cost of the machine as a whole.

OBJECT AND SUMMARY OF THE INVENTION

The present invention aims at providing a photoelectric copying machine incorporating means for securely and easily removing image transfer members from the sensitizer after transfer is completed. In other words, the present invention provides a photoelectric copying machine capable of removing the image transfer members from the sensitizer without using any specific removal means.

The present invention provides a photoelectric copying machine that allows the sensitizer to form toner images that are transferred by being placed on a belt, while the toner images formed by the sensitizer will be transferred onto the image transfer members to subsequently cause said image transfer member to be removed from the sensitizer, while said belt means is supported by two drums having different diameters from each other.

A preferred embodiment of the present invention provides a pair of drums each having a small diameter to be available for transferring the sensitizer, which are set in positions from which positioned where the toner image on the sensitizer is transferred to the image transfer members, while said drums are arranged to come into contact with said sensitizer at an angle greater than 90° to enable said sensitizer to be stably held by drums, and so the image transfer member can be moved smoothly during the copying service.

BRIEF DESCRIPTION OF THE DRAWINGS

The present invention will become better understood from the detailed description given below and the accompanying drawings which are given by way of illustration only, and thus are not limitative of the present invention and wherein.

DETAILED DESCRIPTION OF THE INVENTION

Figure 1:
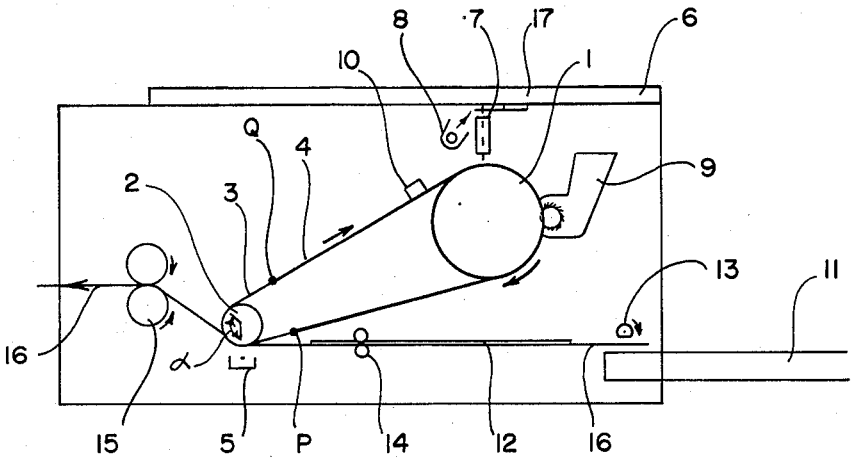
FIG. 1 is a sectional view of the photoelectric copying machine as a preferred embodiment of the present invention.

FIG. 1 shows an internal structure of the photoelectric copying machine as a preferred embodiment of the present invention, comprising a rotary drum 1, a small-diameter drum 2 that makes up a pair together with drum 1 and supports an endless belt 3, a sensitizer 4 being laid above said belt 3 which is set across drums 1 and 2, a charger 5 that uniformly charges said sensitizer 4 so that it bears a specific polarity, a mobile draft carrier 6, a lens 7 that causes reflective light of a draft on the draft carrier 6 illuminated by the illuminator 8 to be imaged onto the sensitizer 4, a developing unit 9, and a discharger 10. Sensitizer 4 has the position P at the tip portion and the position Q at the end portion, while it is transferred in the arrowed direction by rotation of drums 1 and 2. This sensitizer 4 stops at a position shown in FIG. 1.

As soon as the copying operation is initiated drums 1 and 2 respectively start to move to cause the sensitizer 4 to also move. When the sensitizer 4 reaches the charger 5, said sensitizer 4 is charged by the charger 5 to become a specific polarity. After the charge is completed, sensitizer 4 will be sent to the exposure unit comprising an illumination unit 8 and a lens 7. As soon as the tip portion P of said sensitizer 4 reaches the projection position of lens 7, said draft carrier 6 moves synchronous with it so that the image exposure can be executed from the tip portion of the draft, thus causing a static potential image corresponding to the draft picture to be gradually formed from the tip portion of the sensitizer 4. Such a potential image is visualized by the developing unit 9 to become a toner image.

Thus, as soon as the sensitizer has made a full turn, a toner image is formed on the sensitizer 4. When said sensitizer 4 starts to make the second turn, synchronous with the arrival of the tip portion P at the position of the charger 5, a copying paper 12 being sent to a predetermined position by a supply roller 13 from the cassette 11 will be transported by conveyer means such as a conveyer roller 14 so that the paper top end will reach the position of the charger 5. The charger concurrently functions as an image transfer unit for statically transferring the toner image of the sensitizer 4 onto the copying paper 12. In other words, the charger not only charges the sensitizer 4, but it also transfers the toner image at the same time while performing its second turn.

As described above, while passing through the charger 5 that concurrently functions as a transfer unit, the copying paper 12 will leave the sensitizer 4 by itself, which is then sent to a stationary roller 15 along the transfer path 16 via guide means. The stationary roller 15 causes the toner image on said paper 12 to be thermally fixed onto it, and the image fixed paper is then sent outside via the paper transport path.

After passing through the transfer position, the sensitizer 4 reaches the discharge unit 10, which then discharges the remaining charge. After discharge is completed, photoelectricity is discharged via the illuminator 8 and lens 7. A white plate 17 which was not present in the exposure position when the rear end Q of the sensitizer 4 just passed through the exposure position, is then set to the draft exposure position (shown by the dotted line) so that light reflected by the illuminator 8 will be irradiated via lens 7 onto the sensitizer 4, thus removing photoelectricity.

Also, a white portion that executes a function corresponding to said white plate 17 may be provided in the lower tip portion of the draft carrier if only such a structure is provided, which allows the draft carrier 6 to return to the forward-movement start position upon completing a return movement and until the tip portion P reaches the exposure position so that the draft carrier 6 will pass through the exposure position in the rear end Q of the sensitizer 4.

After the photoelectricity is discharged from the sensitizer 4, the development unit 9 then clears the toner remaining in the sensitizer 4. After executing these procedures, the process needed for electrically copying the draft contents onto a copying paper is completed. If a plurality of papers must be electrically and automatically copied, the sensitizer 4 enters the third turn to repeat these operations thus described. As soon as a piece of copying paper or the last piece of plural papers has been copied, the sensitizer 4 performs a total of 3 full turns so that any residual toner and photoelectricity will be completely eliminated from it, and finally it stops at the position shown in FIG. 1.

Figure 2:
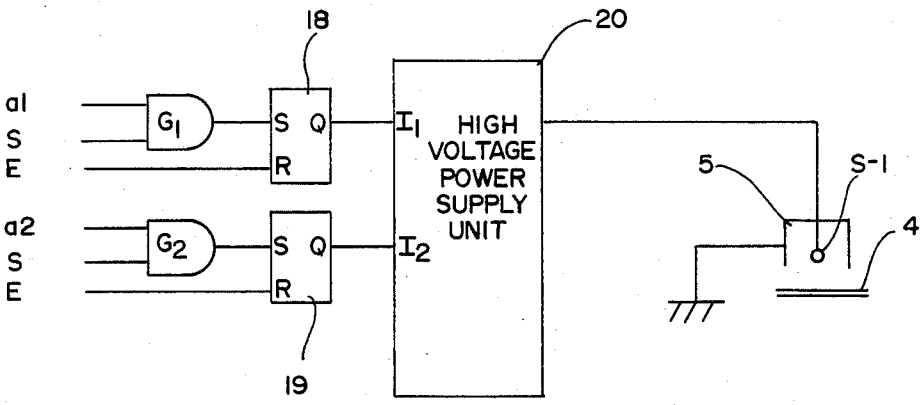
FIG. 2 is a simplified block diagram of a voltage switching controller of the charger embodied by the present invention.

As described above, the preferred embodiment of the present invention executes charge and photoelectrical copying by using the identical means. Although charge and transfer can be achieved using the identical polarity, these cannot always be achieved by applying the same voltage. To ensure correct operations, it is necessary to feed voltages that are variable during the first and second turns of the sensitizer into the discharge wire of the charger 5. An example is shown in FIG. 2. High voltage power supply unit 20 feeds a high voltage to wire 5-1 of the charger 5. Said power supply unit 20 cannot feed such a high voltage to said wire 5-1 unless a signal is fed to input terminals I1 and I2. When the input terminal I1 receives a signal, it feeds a high voltage V1, being suitable for charge, into wire 5-1. If a signal enters the input terminal I2, a high voltage suitable for transfer will be fed to wire 5-1.

Said input terminals I1 and I2 respectively receive signals from flip flops 18 and 19. Reset terminals R provided for flip flop 18 and 19 contain signal E indicating that the copying operation is completed. In addition, set terminal S of flip flop 18 receives a signal from gate G1 that opens itself while both the copy start signal S and signal a1 denoting the first turn of the sensitizer are present. Set terminal S of flip flop 19 receives a signal from gate G2 that opens itself upon entry of signals S and a2 denoting the second turn of the sensitizer 4.

As a result, during the first turn of the sensitizer 4, voltage V1 which is suitable for charging is fed to wire 5-1 of the charger 5, while voltage V2 suitable for transfer is fed to wire 5-1 during the second turn of the sensitizer 4. If the identical voltage is fed to the transfer and charge operations, no means for controlling the high voltage switching operation shown in FIG. 2 is needed. The preferred embodiment of the present invention executes the image exposure and the photoelectric discharge via the identical means. As with the charger 5, said means controls the voltage switching to cause the luminance irradiating onto the sensitizer 4 to vary by applying the image exposure and the photoelectric discharge.

In reference to the structure described above, means for removing paper 12 being an image transfer member is described below. As shown in FIG. 1, the charger 5 that concurrently performs charge and transfer is sent in a position opposite to a small-diameter drum 2. Said small-diameter drum 2 should desirably have a maximum of 50 mm of diameter to enable paper 12 to go off by itself. Such a maximum of 50 mm of the drum diameter is designed to deal with papers stably composed for conventional uses, and so if any thick paper having too firm structure is used, it can be removed from a drum having more than 50 mm of the diameter. According to the test results confirmed by the inventors, papers were smoothly sent out of drums, i.e., one that had 80 mm of diameter for the larger drum, and the other one being 25 mm of diameter for the small drum, respectively.

In the present embodiment, sensitizer 4 comes into contact with drum 2 at an angle greater than 90° so that drum 2 can correctly turn its movement direction immediately after said drum causes the sensitizer 4 to transfer the image transfer member. As a result, when paper 12 is conveyed so that it comes into contact with the sensitizer 4 and faces the charger 5, due to the static transfer effect applied from the back, toner image is transferred onto the copying paper 12. After said paper has passed through the transfer process, the sensitizer 4 will turn its direction along the circumference of drum 2, while said paper 12 in close contact with the sensitizer 4 will be carried forward together with said sensitizer 4. However, since the drum diameter is small and the angle in contact with the sensitizer is greater than 90°, paper 12 will leave the sensitizer 4 by itself due to its own strength, and so it leaves the sensitizer 4 furthermore as the sensitizer 4 proceeds further. After being completely off from the sensitizer 4, paper 12 is then sent to the stationary roller via guide means.

It should be noted that such a paper 12 must be firm enough to withstand the whole processes. If paper 12 is too weak, even if drum 2 has an optimum small diameter, such a weak paper can neither properly follow up the movement of the sensitizer 4 nor leave it. Also, even if a paper has a normal strength, if the drum 2 comes into contact with the sensitizer 4 at angle below 90°, irrelevant of small diameter of said drum 2, paper 12 will be obliged to proceed while being tightly pressed against the sensitizer 4. The present invention effectively provides a function to enable the copied paper to leave the senstizer 4 by ensuring more than 90° of the contact angle between the drum 2 and sensitizer 4 so that the sensitizer 4 can immediately turn the direction of the movement.

As described above, since the small-diameter drum 2 and the sensitizer 4 come into contact with each other at an angle greater than 90°, when the sensitizer 4 stops so that it comes into contact with said drum 2, said sensitizer incur damage such as breakage due to the presence of drum 2 due to residual ozonide generated by the charger 5, the sensitizer 4 may eventually be fatigued. To prevent these, as shown in FIG. 1, the tip portion P and rear end portion Q are provided for the sensitizer 4 so that the stop position of said sensitizer 4 can be correctly determined at a position in which the belt 3 comes into contact with said drum 2 without the drum 2 being contacted by the sensitizer 4. If the sensitizer 4 is not provided with any edge portion, the sensitizer 4 may be provided with an area of no effect having a length corresponding to the angle of its contact with said drum 2 so that said area will face said drum 2.

The copying mechanism shown in FIG. 1 is based on the two rotation process. However, the present invention is not limitative of said two rotation process only, but includes a still further embodiment by separately providing the image transfer devices and the charger 5, or by providing said small-diameter drum 2 in a position opposite from the transfer device. The preferred embodiment typically introduces a structure in which a small-diameter drum 2 and a large-diameter drum 1 are provided so that the sensitizer 4 is held between them. A still further embodiment provides a plurality of small-diameter drums 2 so that the sensitizer 4 can be smoothly moved by correctly arrange the position of one of plural drums 2 opposite from the image transfer device, enabling it to come into contact with the sensitizer at an angle greater than 90°.

The preferred embodiment of the present invention typically provides a mobile sensitizer 4 via belt means 3 for making up toner images, a small-diameter drum 2 for transporting said sensitizer 4 to a position opposite from the image transfer position, and a sensitizer 4 that comes into contact with said drum 2 at an angle greater than 90°. As a result, after an image is transferred onto the image trasfer member, when the sensitizer 4 moves, by effect of the paper strength, a paper that received the transferred image leaves the sensitizer 4 by itself. In other words, the preferred embodiment does not need any means for forcibly removing the copied paper, thus eventually realizing a very compact size and low cost of this copying machine.

What is claimed is:

1. A photoelectric copying machine for transferring an image from an original document to an image transfer medium, said machine comprising:

first and second rotating drums;

an endless belt encircling said first and second rotating drums and moving in concert with the rotation thereof;

a sensitizer formed on only a substantial portion of the surface of said endless belt, and movable therewith, wherein said endless belt comes to rest with the portion thereof which is not covered by said sensitizer resting around said first rotating drum;

means for moving the image transfer medium through said machine along a predetermined path, said path tangentially intersecting said endless belt adjacent said first rotating drum;

a charger positioned along said predetermined path adjacent said first rotating drum to precharge said sensitizer as it passes thereby;

optical image potential forming means for reading said original document and optically forming a potential variation on said sensitizer corresponding to the image present on said original document; and means for supplying toner to said potential variation formed on said sensitizer by said optical image potential forming means to form a toner image on said sensitizer corresponding to said image from said original document;

said charger also applying charge to said toner image as said image transfer member passes thereby to transfer said toner image to said image transfer member.

2. The copying machine of claim 1 further comprising two level voltage supply means for applying a first voltage to said charger to precharge said sensitizer and for applying a second voltage to said charger to transfer said toner image to said image transfer medium.

3. The copying machine of claim 1 wherein said first rotating drum is sized relatively small and where said first rotating drum and said sensitizer contact each other at an angle greater than 90° to facilitate the stripping of said image transfer medium with said toner image formed thereon from said sensitizer.

4. The copy machine of claim 3 wherein said first rotating drum has a diameter of 25 to 50 mm.

5. The copy machine of claim 4 wherein said second rotating drum has a diameter of 80 mm.

6. The copy machine of claim 1 wherein said means for moving moves said endless belt around said first and second rotating drums two complete rotations to perform a single complete image transfer.

7. The copy machine of claim 1 further comprising fixing means, positioned along said predetermined path downstream of said charger, for fixing said toner image onto said image transfer medium.

8. The copy machine of claim 1 further comprising a discharger for discharging said sensitizer after image transfer by said charger.

9. The copy machine of claim 8 wherein said optical image potential forming means further removes residual photoelectricity from said sensitizer after image transfer by said charger.

* * * * *